US005716124A

United States Patent [19]

Hsu

[11] Patent Number: 5,716,124

[45] Date of Patent: Feb. 10, 1998

[54] MESHED DECORATIVE LIGHT STRING SET

[76] Inventor: Yuan-Shun Hsu, No. 910, Fu-Hsing Rd., Chu-Pei City, Hsing Chu Hsien, Taiwan

[21] Appl. No.: 590,414

[22] Filed: Jan. 23, 1996

[51] Int. Cl.[6] ..... F21S 1/14

[52] U.S. Cl. ..... 362/252; 362/123; 362/806

[58] Field of Search ..... 362/123, 252, 362/806, 800

[56] References Cited

U.S. PATENT DOCUMENTS 5,213,519 5/1993 Dorfman ..... 362/123
5,424,925 6/1995 Jenke et al. ..... 362/123

*Primary Examiner*—Ira S. Lazarus
*Assistant Examiner*—Sara Sachie Raab
*Attorney, Agent, or Firm*—Bacon & Thomas

[57] ABSTRACT

A meshed decorative light string set including an electric plug having a positive line and a negative line arranged into a net for covering over a Christmas tree or an ornamental object, and a plurality of light emitting elements connected to the net.

5 Claims, 3 Drawing Sheets

MESHED DECORATIVE LIGHT STRING SET

BACKGROUND OF THE INVENTION

The present invention relates to decorative light string sets, and relates more particularly to a meshed decorative light string set in which the positive line and negative line of electric wire are arranged into a net conveniently for covering over an ornamental object.

FIG. 1 shows a regular decorative light string set which is generally comprised of an electric plug having two opposite ends respectively connected with a positive line and a negative line, and a plurality of light emitting elements connected to the positive line and the negative line at different locations. This structure of decorative light string set is functional. However, it is inconvenient to install this structure of decorative light string set in a Christmas tree or ornamental object. People tend to cut the lines of the decorative light string set and then to throw the decorate light string set away after one use, because it is difficult to remove the decorative light string set from the Christmas tree or ornamental object after installation.

SUMMARY OF THE INVENTION

The present invention has been accomplished to provide a meshed decorative light string set which eliminates the aforesaid problem. According to the present invention, the positive line and negative line of the electric wire are arranged into a net convenient for covering over an ornamental object, and light emitting elements for example light emitting diodes are respectively mounted on the net and connected to the positive line and negative line of the electric wire.

DETAILED DESCRIPTION OF THE PREFERRED EMBODIMENTS

Figure 1:
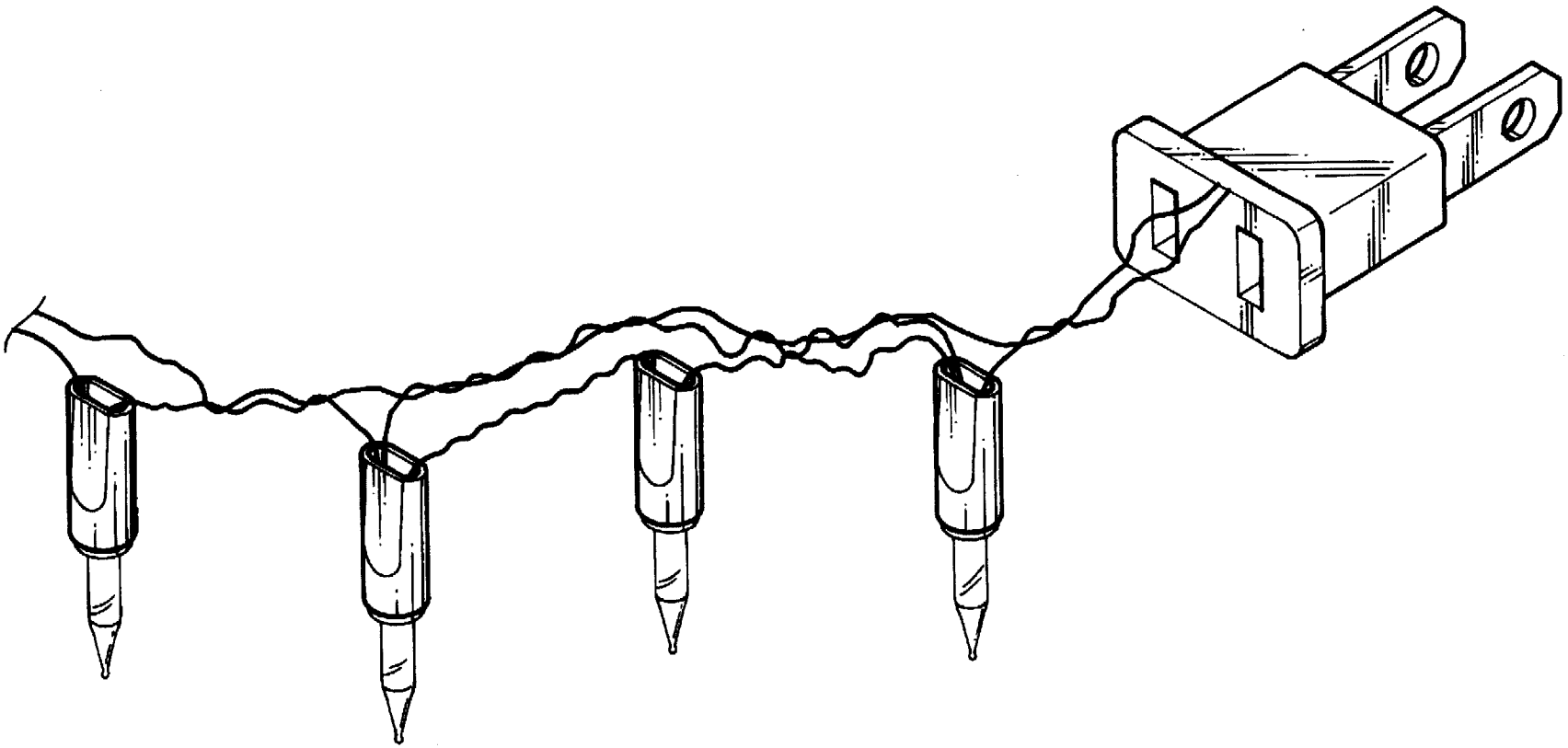
Fig. 1 PRIOR ART
FIG. 1 shows a decorative light string set according to the prior art.
Figure 3:
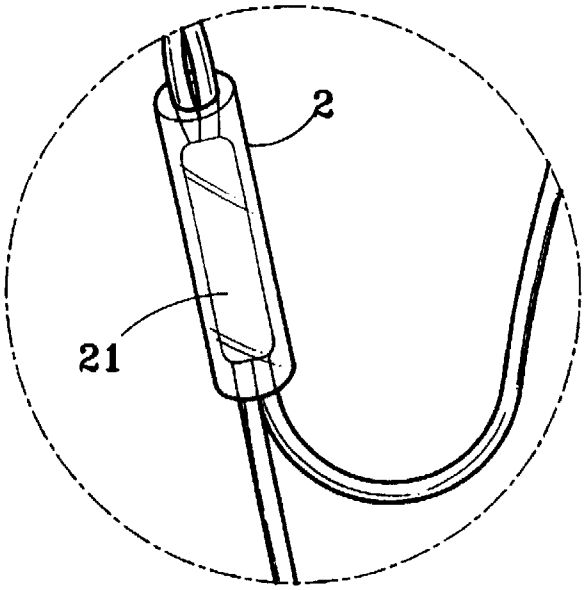
FIG. 3 is an enlarged view of a part of the meshed decorative light string set shown in FIG. 2.
Figure 2:
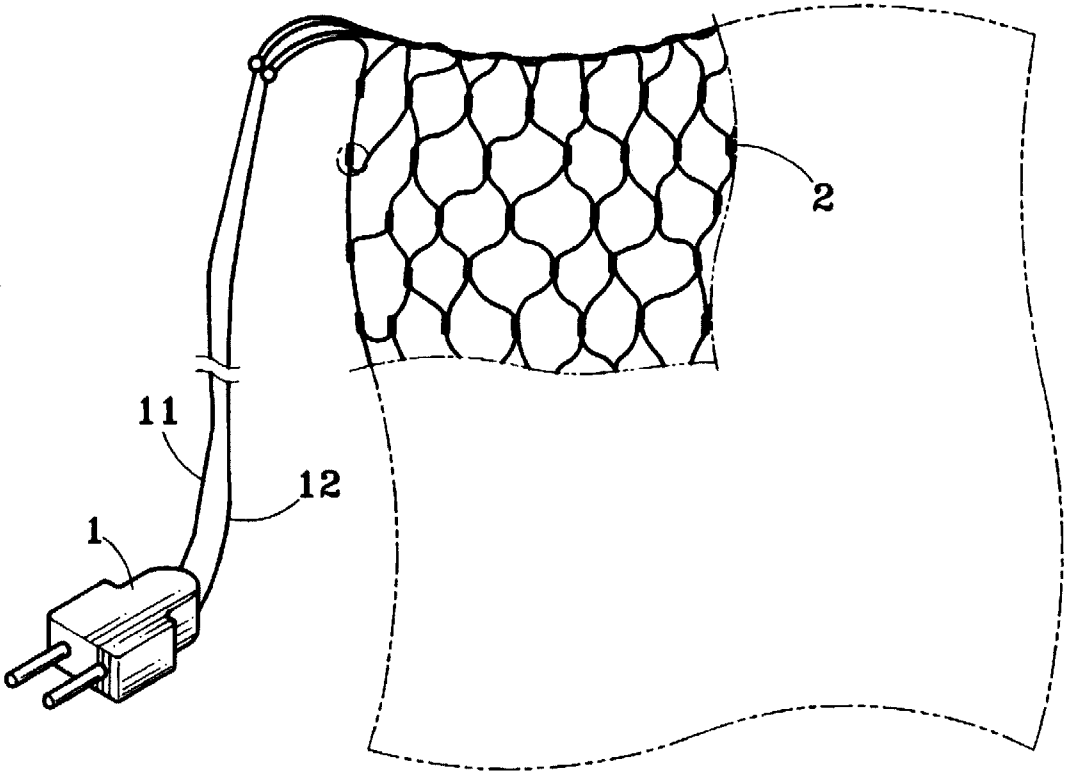
FIG. 2 shows a meshed decorative light string set according to the present invention.

Referring to FIGS. 2 and 3, a meshed decorative light string set in accordance with the present invention is generally comprised of an electric plug 1 having a positive line 11 and a negative line 12 arranged into a net, and a plurality of light emitting elements 21 respectively connected to the net of the positive line 11 and the negative line 12 and covered with a respective plastic jacket 2. The plastic jacket 2 may be made of any of a variety of colors that permits light to pass.

Figure 5:
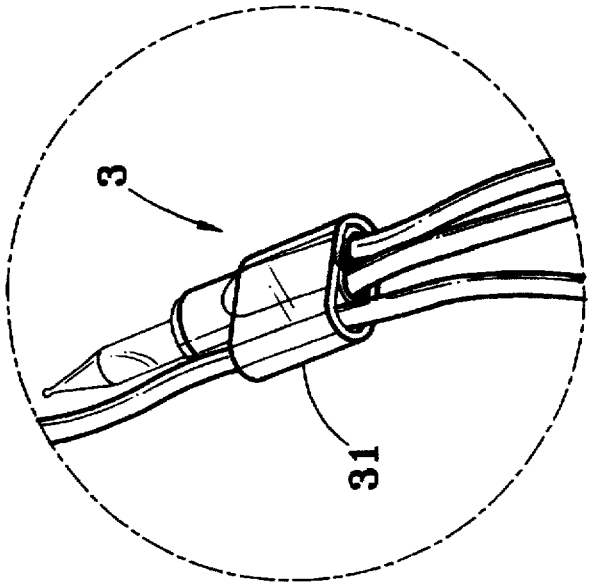
FIG. 5 is an enlarged view of a part of the meshed decorative light string set shown in FIG. 4.
Figure 4:
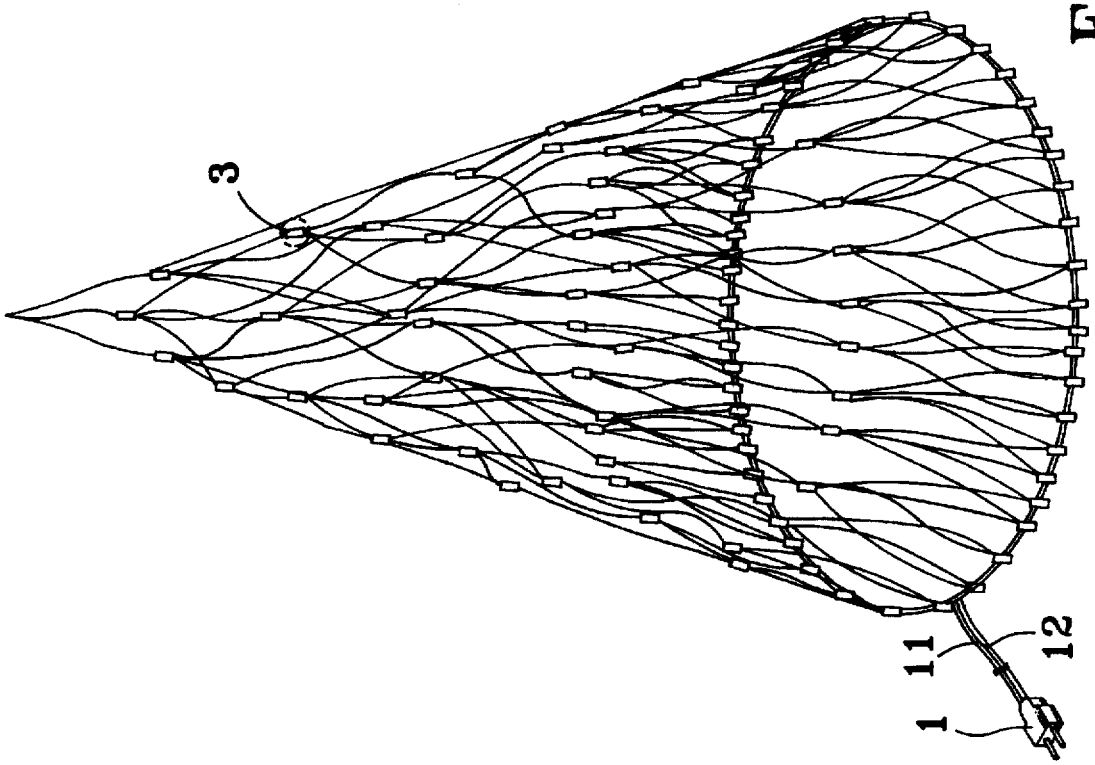
FIG. 4 shows an alternate form of the meshed decorative light string set according to the present invention.

FIGS. 4 and 5 show an alternate form of the meshed decorative light string set, which is comprised of an electric plug 1 having a positive line 11 and a negative line 12 arranged into a conical net, a plurality of light emitting elements 3 respectively fastened to the conical net of the positive line 11 and the negative line 12, and a plurality of plastic jackets 31 respectively fastened to the base of each light emitting element 3 to secure each light emitting element 3 to the conical net of the positive line 11 and the negative line 12.

I claim:

1. A decorative light string set comprising:

a) first and second electrically conductive lines forming a net having a plurality of first areas in which the first and second lines are adjacent and substantially parallel to each other and a plurality of second areas in which the first and second lines are spaced apart from each other; and, b) light emitting elements electrically connected to the first and second electrically conductive lines only at the plurality of first areas.

2. The decorative light string set of claim 1 wherein said net has a conical configuration.

3. The decorative light string set of claim 1 wherein the light emitting elements comprise light emitting diodes.

4. The decorative light string set of claim 1 further comprising plastic jackets encasing the light emitting elements.

5. The decorative light string set of claim 4 wherein the plastic jackets are colored.

* * * * *